United States Patent [19]

Matsushiro

[11] Patent Number: 4,457,101

[45] Date of Patent: Jul. 3, 1984

[54] RADIO-CONTROLLED TOY CAR

[75] Inventor: Yukimitsu Matsushiro, Tokyo, Japan

[73] Assignee: Kabushiki Kaisha Matsushiro, Tokyo, Japan

[21] Appl. No.: 462,699

[22] Filed: Jan. 31, 1983

[30] Foreign Application Priority Data

Dec. 28, 1982 [JP] Japan ..... 57-198804[U]

[51] Int. Cl.[3] ..... A63H 33/26; A63H 17/36

[52] U.S. Cl. ..... 446/456; 446/460; 446/437

[58] Field of Search ..... 46/262, 253, 254, 251, 46/210, 211, 235, 234, 212

[56] References Cited

U.S. PATENT DOCUMENTS 1,682,764 9/1928 Mohr .
4,168,468 9/1979 Mabuchi et al. ..... 46/254 X
4,183,174 1/1980 Barris et al. ..... 46/254

FOREIGN PATENT DOCUMENTS 1009544 5/1957 Fed. Rep. of Germany .
1920790 11/1970 Fed. Rep. of Germany .
1580588 9/1969 France .
1547138 6/1979 United Kingdom ..... 46/262
2084475 4/1982 United Kingdom .

*Primary Examiner*—Mickey Yu
*Attorney, Agent, or Firm*—Lane, Aitken & Kananen

[57] ABSTRACT

A radio-controlled toy car which can smoothly turn its running direction even when the toy car is running with the front wheels kept lifted from the ground, that is, even during the wheelie motion. The toy car according to the present invention comprises a differential gear mechanism, two drive shafts rotatably connected to the differential gear mechanism, two electromagnets for applying a brake force to each of the two drive shafts, independently, when energized in cooperation with one of two magnetic cylindrical members fixed to the two drive shafts separately, a front wheel and, in particular, an auxiliary rear wheel, in addition to two ordinary rear wheels and two front dummy wheels. Furthermore, since a connecting rod is provided for loosely connecting the two drive shafts, the differential gear mechanism functions reliably.

6 Claims, 5 Drawing Figures

RADIO-CONTROLLED TOY CAR

BACKGROUND OF THE INVENTION

1. Field of the Invention

The present invention relates generally to a radio-controlled toy car and more specifically to a radio-controlled toy car which can change its running direction freely even in wheelie motion. Here, the wheelie motion means that a toy car runs only by the rear wheels with the front wheels kept lifted from the ground.

2. Description of the Prior Art

There is well known a radio-controlled toy car which can move in the state where the front wheels are kept lifted from the ground, that is, in wheelie motion. In such a radio-controlled toy car, the wheelie motion is usually achieved in dependence upon a change in the center of gravity of the radio-controlled toy car caused by a reaction generated when the toy car is quickly accelerated frontwardly.

However, in the conventional radio-controlled toy car, since only the front wheels are provided with the function to change the running direction of the toy car, although the running direction of the toy car can be remote-controlled when the front wheels are in contact with the ground, that is, in the ordinary motion, once the toy car runs with the front wheels lifted from the ground, that is, in the wheelie motion, the running direction of the toy car will not be remote-controlled; in other words, the toy car runs only straight ahead in the wheelie running mode. As a result, there exists shortcomings such that the operation of the radio control toy car is simple and, additionally, the toy car often collides against an obstruction being free from remote control.

SUMMARY OF THE INVENTION

With these problems in mind, therefore, it is the primary object of the present invention to provide a radio-controlled toy car which can turn its running direction freely and reliably even when the toy car is running with the front wheels kept lifted from the ground, that is, during the wheelie motion.

Further, another object of the present invention is to provide the radio-controlled toy car having the above-mentioned function in as simple a structure as possible.

To achieve the above-mentioned object, the radio-controlled toy car according to the present invention comprises a differential gear mechanism, two drive shafts rotatably connected to the differential gear mechanism, two brake mechanisms for applying a brake force to each drive shaft independently when activated, and an auxiliary rear wheel disposed backward of the position of the rear wheels in such a way as to be brought into contact with the ground only when the toy car is running in the wheelie running mode and as to change its direction freely.

BRIEF DESCRIPTION OF THE DRAWINGS

The features and advantages of the radio control toy car according to the present invention will be more clearly appreciated from the following description in conjunction with the accompanying drawings in which like reference numeral designate corresponding elements and in which.

DETAILED DESCRIPTION OF THE PREFERRED EMBODIMENTS

In view of the above description, reference is now made to an embodiment of the radio-controlled toy car according to the present invention.

Figure 1:
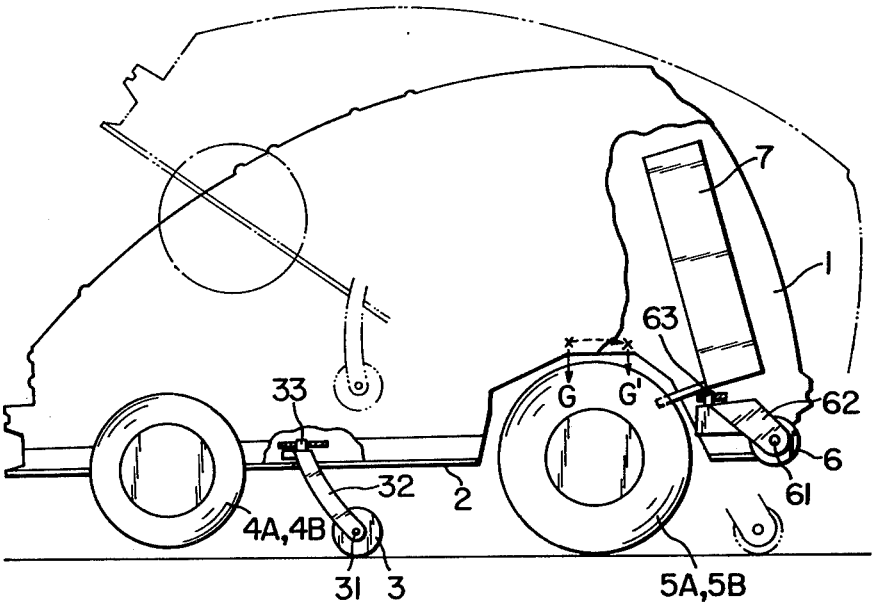
FIG. 1 is a side view roughly showing the structure of the radio-controlled toy car according to the present invention, in which the toy car running in the wheelie running mode is illustrated by dot-dot-dashed lines.

In FIG. 1, the solid lines show the state where a radio-controlled toy car is running in the ordinary running mode, that is, in the state where a single front wheel and two rear wheels are in contact with the ground. The dot-dot-dashed lines show the state where the toy car is running in the wheelie running mode, that is, in the state where only the rear wheels are in contact with the ground with the single front wheel kept lifted from the ground but with an auxiliary rear wheel brought into contact with the ground.

In FIG. 1, the reference numeral 1 denotes a body of the radio-controlled toy car; the reference numeral 2 denotes a chassis of the toy car; the reference numeral 3 denotes a single front wheel; the reference numerals 4A and 4B denote a pair of dummy front wheels; and the reference numerals 5A and 5B denote a pair of rear wheels; the reference numeral 6 denotes a single auxiliary rear wheel. Further, the reference numeral 7 denotes a battery box to house a plurality of battery cells.

As depicted in FIG. 1, the two dummy front wheels 4A and 4B are not in contact with the ground without rotation, even in the ordinary running mode, but rather are only for making the toy car look like a four-wheel toy car.

Being disposed at a longitudinal central position roughly intermediate between the dummy front wheels 4A and 4B and the rear wheels 5A and 5B, the single front wheel 3 is in contact with the ground in the ordinary running mode, in order to support the car body 1 together with the rear wheels 5A and 5B, in such a way as to be rotatable about a front wheel pin 31 fixed to a front wheel lever 32 also pivotably installed to the chassis 2 via a front wheel lever pin 33.

Being disposed at a longitudinal central position backward from the rear wheels, the auxiliary rear wheel 6 is not in contact with the ground in the ordinary running mode but is in contact with the ground in the wheelie running mode, in order to support the car body 1 together with the rear wheels 5A and 5B, in such a way as to be rotatable about an auxiliary rear wheel pin 61 fixed to an auxiliary rear wheel lever 62 also pivotably installed to the chassis 2 via an auxiliary rear wheel lever pin 63.

Being disposed obliquely near the rear end of the toy car body 1, the battery box in which a plurality of battery cells are housed serves to locate the center of gravity of the toy car slightly forward beyond the axial position of the rear wheels 5A and 5B in the ordinary running mode; however, that position also serves to shift the center of gravity of the car body slightly backward beyond the axial position of the rear wheels 5A and 5B in the wheelie running mode.

Therefore, in the case where the radio-controlled toy car is running at a constant speed or is started at a relatively low acceleration, since the center of gravity of the toy car body is located forward of the rear wheels 5A and 5B as depicted by the reference character G in FIG. 1, the front wheel 3 is brought into contact with the ground to run in the ordinary running mode. In contrast with this, in the case where the radio control toy car is started at a relatively high acceleration, since the center of gravity of the toy car body is shifted backward from the rear wheels 5A and 5B as depicted by the character reference G' in FIG. 1, the front wheel 3 is lifted from the ground to run in the wheelie running mode, as depicted by the dot-dot-dashed lines in FIG. 1.

Figure 2:
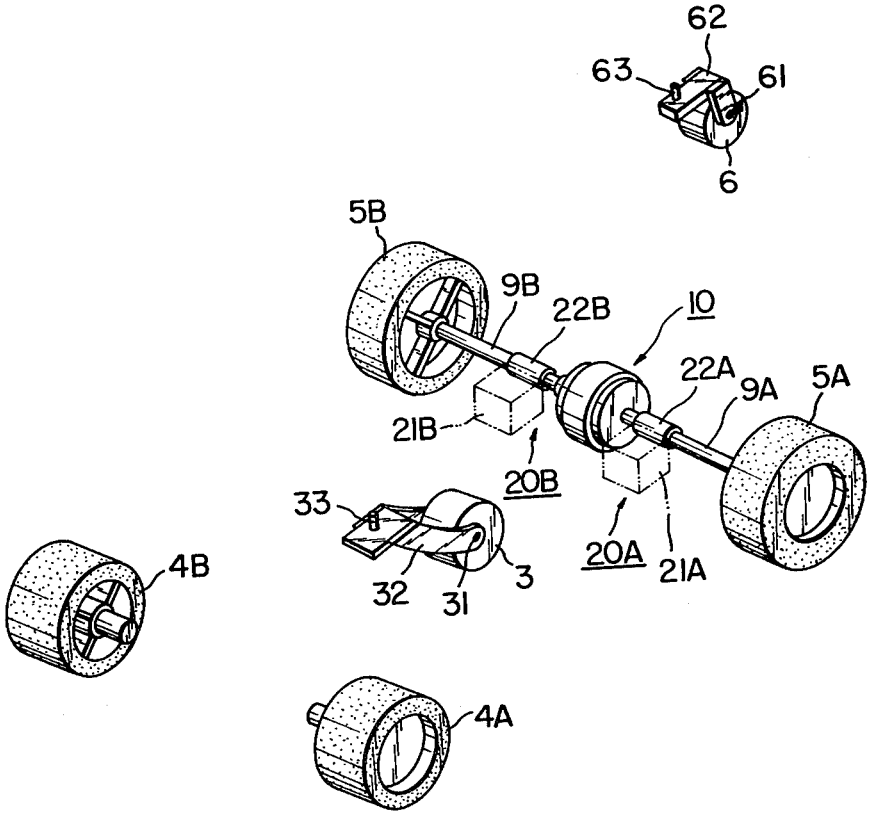
FIG. 2 is a perspective view showing, in an exploded view fashion, only the essential portions of the radio-controlled toy car according to the present invention.

FIG. 2 shows a front wheel 3, left-hand and right-hand dummy front wheels 4A and 4B, left-hand and right-hand rear wheels 5A and 5B, connected by means of a differential gear mechanism 10, and an auxiliary rear wheel 6.

The two rear wheels 5A and 5B are respectively fixed to the outer ends of a separated pair of drive shafts 9A and 9B separately, and the two drive shafts 9A and 9B are connected to each other through a differential gear mechanism 10. The drive shafts 9A and 9B are both made of a nonmagnetic material.

Further, in FIG. 2, the reference numerals 20A and 20B denote a pair of brake mechanisms including a pair of electromagnets 21A and 21B disposed on the frontwardly of the rear wheels symmetrically with respect to the longitudinal central axis of the toy car body for applying a brake force to the left-hand or right-hand rear wheel 5A or 5B independently, in cooperation with a pair of cylindrical members 22A and 22B fixedly separately fitted to the drive shafts 9A and 9B separately. The cylindrical members 22A and 22B are made of a magnetic material provided with a small residual magnetism such as, for instance, ferrite or manganese steel.

Figure 3:
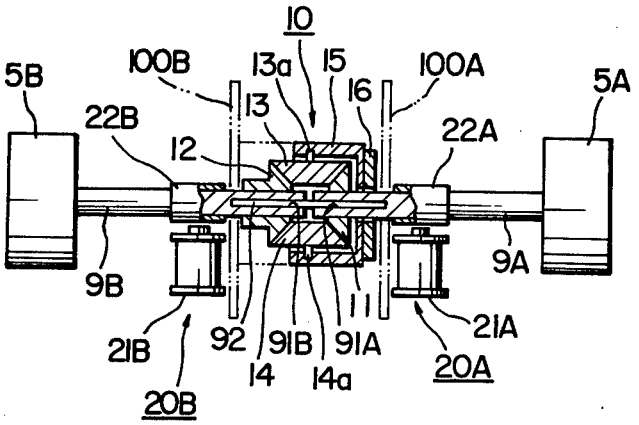
FIG. 3 is a top view, partially in cross-section, showing the rear wheel portion of the radio-controlled toy car according to the present invention.

The electromagnet 21A or 21B fixed to the chassis 2 separately includes a core and a solenoid (both not shown). Therefore, when the solenoid is energized in response to a radio signal indicative of brake application transmitted from a control box (not shown), a magnetic field is generated from the outer end surface of the core. As depicted in FIG. 3, since there is disposed a cylindrical member 22A or 22B made of a magnetic material near the electromagnet 21A or 21B with a small gap between the outer end surface of the core and the outer cylindrical surface of the cylindrical member, when the electromagnet 21A or 21B is operative, the cylindrical member 22A or 22B is attracted toward the electromagnet 21A or 21B, with the result that a great frictional force is generated between the outer end surface of the core and the outer cylindrical surface of the cylindrical member 22A or 22B or between the outer cylindrical surface of the drive shaft 9A or 9B and a drive shaft supporting member described later, in order to apply a brake force to the toy car.

Further, in this embodiment, although the cylindrical members 22A and 22B are made of a magnetic material, since the drive shafts 9A and 9B are made of a nonmagnetic material, no magnetic force is transmitted from the left-hand drive shaft 9A to the right-hand drive shaft 9B or vice versa, while the electromagnet 21A or 21B is being energized.

In FIG. 3, the differential gear mechanism 10 comprises a pair of side gears 11 and 12 and a pair of pinion mates 13 and 14 disposed between the side gears 11 and 12 so as to engage with the side gears with an appropriate clearance. Two rotary shafts **13*a* and 14*a* of these pinion mates 13 and 14 are rotatably supported by a differential gear box 15, separately. The central hole of the differential gear box 15 is loosely fitted to one of the drive shafts 9A and 9B. A drive gear 16 is fixed to the differential gear box 15 so as to be rotatable about the drive shaft 9A together with the gear box 15. This drive gear 16** is connected to a motor (not shown) via an intermediate gear (not shown).

The rotational relationship between the drive gear 16 and the drive shafts 9A and 9B will be described hereinbelow.

In an ordinary state, when the drive gear 16 is driven, the rotational force is transmitted to the left-hand and right-hand drive shafts 9A and 9B, equally, through the differential gear box 15, the pinion mates 13 and 14 and the side gears 11 and 12, so that the two drive shafts 9A and 9B are rotated at the same rotational speed. However, in the case where any one of the drive shafts 9A and 9B is braked by one of the brake mechanisms 20A and 20B, one of the side gears 11 and 12 is braked and the other of the side gears 11 and 12 is rotated at a higher speed to increase the revolution speed thereof, because of the function of differential gears.

As depicted in FIG. 3, the drive shaft 9A or 9B is formed with a bore 91A or 91B extending to a depth along the axis thereof from the inner end surface thereof. Further, a connecting rod 92 is loosely inserted into the bores 91A and 91B at its either end in such a way as to rotatably support the drive shafts 9A and 9B independently.

Further, in FIG. 3, the reference numerals 20A and 20B denote a pair of brake mechanisms including a pair of electromagnets 21A and 21B and a pair of magnetic cylindrical members 22A and 22B already explained with reference to FIG. 2.

Figure 4:
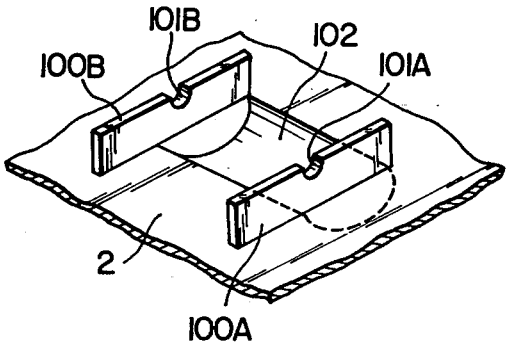
FIG. 4 is a perspective view showing part of the chassis of the radio control toy car according to the present invention, in which two drive shaft supporting portions are illustrated.

FIG. 4 shows a pair of drive-shaft supporting plates 100A and 100B vertically fixed to the chassis 2. In FIG. 4, since the drive-shaft supporting plate 100A or 100B is formed with a semicircular shaft supporting cutout 101A or 101B respectively, the left-hand drive shaft 9A is supported by the supporting cutout 101A at a position between the drive gear 16 and the left-hand cylindrical member 22A and the right-hand drive shaft 9B is supported by the supporting cutout 101B at a position between the right-hand side gear 12 and the right-hand cylindrical member 22B. Therefore, each drive shaft 9A or 9B rotates sliding on the surface of the semicircular shaft supporting cutout 101A or 101B under the restriction of the axial movement of the drive shaft 9A or 9B.

Further, in FIG. 4, the reference numeral 102 denotes a recessed portion within which the differential gear mechanism 10 is housed together with the drive gear 16.

Figure 5:
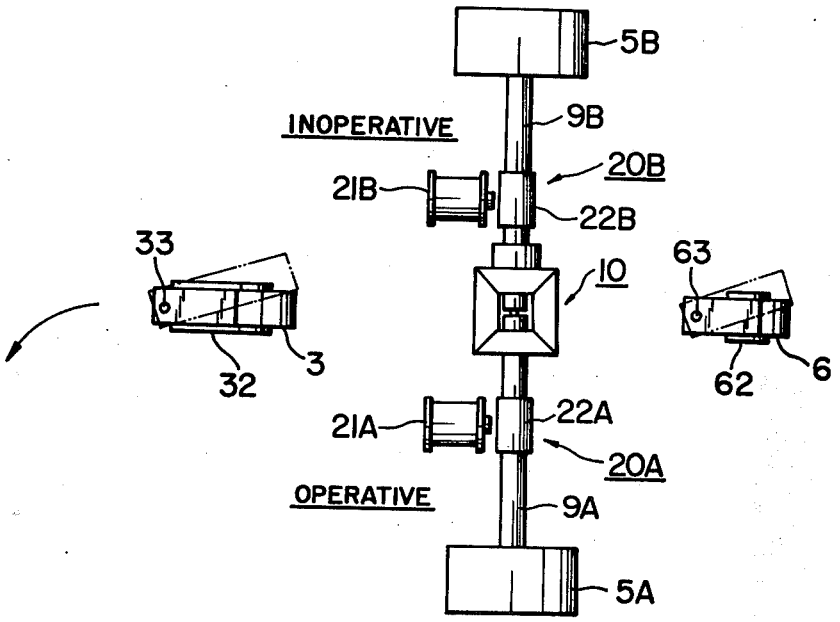
FIG. 5 is a top view for assistance in explaining the operation of the direction-turning mechanism provided for the radio-controlled toy car according to the present invention.

The operation of the radio control toy car according to the present invention will be described hereinbelow with reference to FIG. 5.

In the case where the radio-controlled toy car is required to move in the ordinary running mode, the user transmits a radio signal from a control box (not shown) to the toy car for slowly starting the toy car, for instance, frontward and next keeping the toy car running at a constant speed or with a small acceleration.

In this ordinary running mode, in the case where the toy car is required to turn, for instance, to the left, the user transmits a radio signal from the control box to make the left-hand electromagnet 21A operative and the right-hand electromagnet 21B inoperative. In this case, the revolution of the left-hand rear wheel 5A is braked, and; the revolution of the right-hand rear wheel 5B is speeded up because of the presence of the differential gear mechanism 10. As a result, the radio control car tends to turn to the left. In this ordinary running mode, since the front wheel 3 is in contact with the ground in such a way as to freely change its direction, the direction of the front wheel 3 is shifted to the right-hand side, as shown by the dot-dot-dashed lines in FIG. 5, by the toy car itself. Therefore, without producing a great frictional force between the front wheel 3 and the supporting surface of the chassis 2, the radio control toy car can smoothly turn to the left, as depicted by the arrow in FIG. 5.

In the ordinary running mode, in the case where the toy car is required to turn, for instance, to the right, the user transmits a radio signal from the control box to make the left-hand electromagnet 21A inoperative and the right-hand electromagnet 21B operative. In this case, the revolution of the right-hand rear wheel 5B is braked, and; the revolution of the left-hand rear wheel 5A is speeded up because of the presence of the differential gear mechanism 10. As a result, the radio control car tends to turn to the right. In this ordinary running mode, since the front wheel 3 is in contact with the ground in such a way as to freely change its direction, the direction of the front wheel 3 is shifted to the left-hand side opposite to the dot-dot-dashed lines shown in FIG. 5 by the toy car itself. Therefore, the toy car can smoothly turn to the right.

Further, in this ordinary running mode, the user can move the radio control car backward. In the case where the toy car is required to turn, for instance, to the left during the backward motion, the user transmits a radio signal from the control box to make the left-hand, electromagnet 21A inoperative and the right-hand electromagnet 21B operative in order to apply a brake force only to the right-hand rear wheel 5B. In contrast with this, in the case where the toy car is required to turn to the right during the backward motion, the user transmits a radio signal from the control box to make the left-hand electromagnet 21A operative and the right-hand electromagnet 21B inoperative, in order to apply a brake force only to the left-hand rear wheel 5A.

In the case where the radio control toy car is required to move in the wheelie running mode, the user transmits a radio signal from a control box to the toy car for quickly starting or accelerating the toy car frontward. When a great acceleration is applied to the toy car, since the center of gravity of the toy car is shifted rearward a little beyond a position of the drive shafts 9A and 9B, a rotational moment to lift up the car body 1 is generated. As a result, the front wheel 3 is lifted off from the ground to the position where the auxiliary rear wheel 6 is brought into contact with the ground; that is, the radio control car becomes the wheelie running mode.

In this wheelie running mode, in the case where the toy car is required to turn, for instance, to the left, the user transmits a radio signal from the control box to make the left-hand electromagnet 21A operative and the right-hand electromagnet 21B inoperative. In this case, the revolution of the left-hand rear wheel 5A is braked, and; the revolution of the right-hand rear wheel 5B is speeded up because of the presence of the differential gear mechanism 10. As a result, the radio control car tends to turn to the left. In this wheelie running mode, since the auxiliary rear wheel 6 is in contact with the ground in such a way as to freely change its direction, the direction of the auxiliary rear wheel 6 is shifted to the right-hand side, as shown by the dot-dot-dashed lines in FIG. 5, by the toy car itself. Therefore, without producing a great frictional force between the auxiliary rear wheel 6 and the supporting surface of the chassis 2, the radio control toy car can smoothly turn to the left, as depicted by the arrow in FIG. 5.

In the wheelie running mode, in the case where the toy car is required to turn, for instance, to the right, the user transmits a radio signal from the control box to make the left-hand electromagnet 21A inoperative and the right-hand electromagnet 21B operative. In this case, the revolution of the right-hand rear wheel 5B is braked, and; the revolution of the left-hand rear wheel 5A is speeded up because of the presence of the differential gear mechanism 10. As a result, the radio control car tends to turn to the right. In this wheelie running mode, since the auxiliary rear wheel 6 is in contact with the ground in such a way as to freely change its direction, the direction of the auxiliary rear wheel 6 is shifted to the left-hand side opposite to the dot-to-dot-dashed lines in FIG. 5 by the toy car itself. Therefore, the toy car can smoothly turn to the right.

Further, in this wheelie running mode, the user cannot move the radio-controlled car backward. This is because when the toy car runs backward, the center of gravity of the toy car is readily shifted frontward beyond the rear wheel position, thus becoming the ordinary running mode.

In brief summary, the features and advantages of the present invention are as follows:

(1) Since there is provided the auxiliary rear wheel 6 to support the toy car body in the wheelie running mode, the toy car can freely change its running direction.

(2) Since a pair of two electromagnets are used as the brake mechanism, it is possible to make the brake mechanism simple and reliably.

(3) Since a pair of the drive shafts are connected to each other by a connecting rod, the center of one drive shaft well coincides with that of the other drive shaft, with the result that it is possible to operate the differential gear mechanism more smoothly and reliably.

(4) In the case where a pair of the drive shafts are connected only via the differential gear mechanism, although it is necessary to support each drive shaft at two or more positions for matching the centers of the two drive shafts, since there is provided a connecting rod, it is possible to support each drive shaft at one position, thereby being possible to make the structure simple.

(5) Since there is provided the front wheel 3 to support the toy car body in the ordinary running mode, the toy car can freely change its running direction, even if the brake mechanism is disposed for the rear wheels.

(6) If the distance between the rear wheels 5A and 5B and the front wheel 3 or the auxiliary rear wheel 6 is designed to be small, the toy car can turn its direction with a small turning radius. Additionally, it is possible to design a small-sized toy car easily.

As described above, in the radio-controlled toy car according to the present invention, since the right-hand and left-hand drive shafts are connected to each other via the differential gear mechanism by the aid of a connecting rod and these two drive shafts are braked separately by means of two electromagnets and since the auxiliary rear wheel is additionally provided in such a way as to change its direction freely, it is possible to change the running direction of the toy car smoothly when the toy car is running during wheelie motion, in dependence upon as simple a structure as possible.

It will be understood by those skilled in the art that the foregoing description is in terms of preferred embodiments of the present invention wherein various changes and modifications may be made without departing from the spirit and scope of the invention, as set forth in the appended claims.

What is claimed is:

1. A radio-controlled toy car, which can run frontward or rearward in an ordinary running mode but runs only frontward in a wheelie running mode when accelerated frontward in response to radio signals transmitted from a control box, which comprises:

(a) a differential gear mechanism;

(b) a pair of drive shafts rotatably connected to said differential gear mechanism separately;

(c) a pair of rear wheels fixedly connected to said two drive shafts separately;

(d) a pair of brake mechanisms disposed near said drive shafts separately for applying a brake force to each drive shaft independently when activated; and (e) an auxiliary rear wheel disposed backward from the position of said rear wheels at the longitudinal central axis of the toy car in such a way as to be brought into contact with the ground only when the toy car runs in the wheelie running mode and as to change its direction freely, whereby the toy car can turn its running direction smoothly by the aid of said auxiliary rear wheel in the wheelie running mode when any one of said brake mechanisms is activated.

2. A radio-controlled toy car as set forth in claim 1, which further comprises a connecting rod either end of which is loosely fitted to a central bore formed in each of said two drive shafts along the central axis of said drive shaft, whereby it is possible to operate said differential gear mechanism more reliably.

3. A radio-controlled toy car as set forth in claim 1, which further comprises a front wheel disposed forward of the position of said rear wheels at the longitudinal central axis of the toy car in such a way as to be brought into contact with the ground when the toy car runs in the ordinary running mode and as to change its direction freely, whereby the toy car can turn its running direction smoothly in the ordinary running mode when any one of said brake mechanisms is activated.

4. A radio-controlled toy car as set forth in claim 1, wherein each of said brake mechanisms comprises:

(a) an electromagnet including a magnetic core and a solenoid energized in response to a radio signal indicative of brake application transmitted from the control box, and (b) a magnetic cylindrical member fixedly fitted to each drive shaft in such a position that the cylindrical outer surface thereof can be brought into slight contact with the core of said electromagnet, said magnetic cylinder member being brought into pressure contact with the core of said electromagnet when the solenoid of said electromagnet is energized for applying a frictional brake force to said magnetic cylindrical member.

5. A radio-controlled toy car as set forth in claim 4, wherein said magnetic cylindrical member is made of a magnetic material provided with a small residual magnetism.

6. A radio-controlled toy car, which can run frontward or rearward in an ordinary running mode but runs only frontward in a wheelie running mode when accelerated frontward in response to radio signals transmitted from a control box, which comprises:

(a) a differential gear mechanism;

(b) a pair of drive shafts rotatably connected to said differential gear mechanism separately;

(c) a connecting rod either end of which is loosely fitted to a central bore formed in each of said two drive shafts along the central axis of said drive shaft;

(d) a pair of rear wheels fixedly connected to said two drive shafts separately;

(e) a pair of electromagnets including a magnetic core and a solenoid, respectively, energized in response to a radio signal indicative of brake application transmitted from a control box;

(f) a pair of magnetic cylindrical members fixedly fitted to each drive shaft separately in such a position that the cylindrical outer surface thereof can be brought into slight contact with the core of said electromagnet, said magnetic cylindrical member being brought into pressure contact with the core of said electromagnet when the solenoid of said electromagnet is energized for applying a frictional brake force to said magnetic cylindrical member;

(g) a front wheel disposed forward of the position of said rear wheels at the longitudinal central axis of the toy car in such a way as to be brought into contact with the ground when the toy car runs in the ordinary running mode and as to change its direction freely; and (h) an auxiliary rear wheel disposed backward from the position of said rear wheels at the longitudinal central axis of the toy car in such a way as to be brought into contact with the ground only when the toy car runs in the wheelie running mode and as to change its direction freely, whereby the toy car can turn its running direction smoothly by the aid of said front wheel in the ordinary running mode and by the aid of said auxiliary rear wheel in the wheelie running mode when any one of said electromagnets is energized.

* * * * *

UNITED STATES PATENT AND TRADEMARK OFFICE

CERTIFICATE OF CORRECTION

PATENT NO. : 4,457,101

DATED : July 3, 1984

INVENTOR(S) : YUKIMITSU MATSUSHIRO

It is certified that error appears in the above-identified patent and that said Letters Patent is hereby corrected as shown below:

Column 8, line 7, "cylinder" should read -- cylinderical --; and

-- Column 8, line 28, "two" should read -- a pair of --.

Signed and Sealed this

First Day of January 1985

[SEAL]

*Attest:*

GERALD J. MOSSINGHOFF

*Attesting Officer*

*Commissioner of Patents and Trademarks*